United States Patent [19]

Wybro et al.

[11] Patent Number: 4,762,180

[45] Date of Patent: Aug. 9, 1988

[54] MODULAR NEAR-SURFACE COMPLETION SYSTEM

[75] Inventors: Pieter G. Wybro, Richmond; Colin P. Leach, Houston, both of Tex.

[73] Assignee: Conoco Inc., Ponca City, Okla.

[21] Appl. No.: 12,094

[22] Filed: Feb. 5, 1987

[51] Int. Cl.[4] ..... E21B 7/132; E21B 43/017

[52] U.S. Cl. ..... 166/350; 166/351; 166/356; 405/200

[58] Field of Search ..... 166/350, 351, 356, 359, 166/367, 368; 405/195, 200

[56] References Cited

U.S. PATENT DOCUMENTS

| | | | |
|---|---|---|---|
| 3,196,958 | 7/1965 | Travers et al. | 175/7 |
| 3,525,388 | 8/1970 | McClintock | 166/356 |
| 3,705,623 | 12/1972 | van Eek et al. | 166/6 |
| 4,170,266 | 10/1979 | Fayren | 405/195 |
| 4,281,722 | 8/1981 | Tucker | 166/85 |
| 4,388,022 | 6/1983 | Gentry et al. | 166/350 |
| 4,391,332 | 7/1983 | Fayren | 166/350 |
| 4,400,109 | 8/1983 | Gentry et al. | 166/350 |
| 4,426,104 | 1/1984 | Hazelrigg | 285/26 |
| 4,462,717 | 7/1984 | Falcimaigne | 166/350 |
| 4,643,614 | 2/1987 | Laursen | 166/350 |
| 4,673,313 | 6/1987 | Baugh et al. | 405/195 |

FOREIGN PATENT DOCUMENTS 2097358 11/1982 United Kingdom ..... 166/359

OTHER PUBLICATIONS

"New Concept Readied for Deepwater Production"; Marco, Dr. Jose; *Petroleum Engineer;* Mar. 15, 1982; pp. 24–38.

"Modern Production Risers"; Cowan, Ross, and Edward E. Horton; *Petroleum Engineer International;* Feb. 1983, pp. 36–56.

*Primary Examiner*—Stephen J. Novosad
*Assistant Examiner*—Terry Lee Melius
*Attorney, Agent, or Firm*—Richard K. Thomson

[57] ABSTRACT

A modular near-surface completion system that positions the production wellheads in a quiescent zone beneath significant wave activity yet within reach of divers for maintenance and inspection. Each subsea well is provided with (a) its own riser, (b) a riser tensioning buoy and (c) a production well tree mounted atop the riser buoy. Produced fluids are transmitted from the well tree to the floating production platform by means of flexible risers suspended in a catenary loop of sufficient length to permit the platform to be maneuvered to position it for drilling or workover of any of the plurality of templates it services.

15 Claims, 5 Drawing Sheets

MODULAR NEAR-SURFACE COMPLETION SYSTEM

BACKGROUND AND SUMMARY OF THE INVENTION

The present invention relates to a modular well completion system for subsea wells that brings the well tree within the reach of diver access for maintenance and inspection yet keeps the tree below the surface region subject to wind and wave action.

Offshore oil and gas producers are in search of the most economic method of producing well fluids. As the water depth increases, typically the costs associated with producing a barrel of oil goes up, for many systems, more rapidly than a mere linear progression. One factor contributing to the cost escelation of deep water production is the well completion system. As the water depth increases, the structure of subsea wellheads must be made more robust to withstand the pressure. Further, accessing the wellheads for servicing and workovers becomes more difficult and more costly as the increases in water depth exceed the capability of divers, requiring the use of submarines, remotely operated vehicles, or the like. If above-surface wellheads are used, the added movement of a floating production system in deep water resulting from wind and wave forces adds to the complexity of riser tensioner and other clearance systems needed to permit relative movement between the platform and wellhead. Water depth exceeding 1200 feet renders conventional fixed platforms too costly due to the cost of the structural steel required to support the platform.

The present invention eliminates many of the problems associated with both above-surface, and conventional bottom-installed subsea, production wellhead installations. A riser interconnects the subsea well with production equipment, e.g., a production wellhead, mounted atop a modular flotation buoy that is situated in a quiescent zone below the surface beneath the region that is susceptible to wind and wave action but at a depth (preferably 100 to 500 feet) readily accessible to divers for workovers, and the like. The buoy-mounted completion equipment is interconnected to processing equipment on a floating production platform by flexible risers. When utilizing the near-surface completion system of the present invention, the downhole completion will typically be hung-off below the mudline using a tubing hanger/pack-off. Accordingly, most of the weight of the tubing completion will be supported by the well casing, minimizing the weight of tubing that must be supported by the near-surface completion buoys which, in turn, holds down the size of the buoys.

The modular design of the near-surface completion system of the present invention permits installation of the individual component buoys by cranes that may be conventionally found on floating drilling and/or production platforms as well as on conventional construction barges. Alternatively, the component buoys of the modular system may be preassembled and keel hauled as a unit to the point of installation. The positioning of the system in the quiescent zone for the particular application reduces the cost of equipment from what it would be were some portion, or all of the production system, to be exposed to and, therefore, be designed to withstand all weather conditions, including a 100 year storm. It also reduces the cost of installation and maintenance as compared with bottom mounted production systems. This near-surface completion system permits initial exploratory and reservoir delineation drilling to be done prior to the decision to install the riser buoys using conventional techniques, e.g., drilling from a mobile offshore drilling unit using a drilling wellhead located at the seabed. This near-surface completion system also allows for drilling to be carried out from the floating production platform. As a result of this flexibility, installation of one or more buoys can permit early production while additional drilling is conducted on a neighboring template from the production platform without curtailing production or impairing the safety of those personnel on the platform. Installation of the production equipment can be done from either the drilling vessel or from the floating production platform.

Well re-entry for wireline operations and maintenance can be performed either from a workboat or from the production platform. Other maintenance operations, such as maintenance of the Christmas tree and associated equipment, or downhole re-completions, can be carried out from the production platform or from a light work platform such as a small waterplane area twin hull vessel. Accordingly, the use of the more expensive mobile offshore drilling unit can be avoided.

Various other characteristics, features and advantages of the present invention will become apparent after a reading of the following description.

DETAILED DESCRIPTION OF THE PREFERRED EMBODIMENTS

Figure 1:
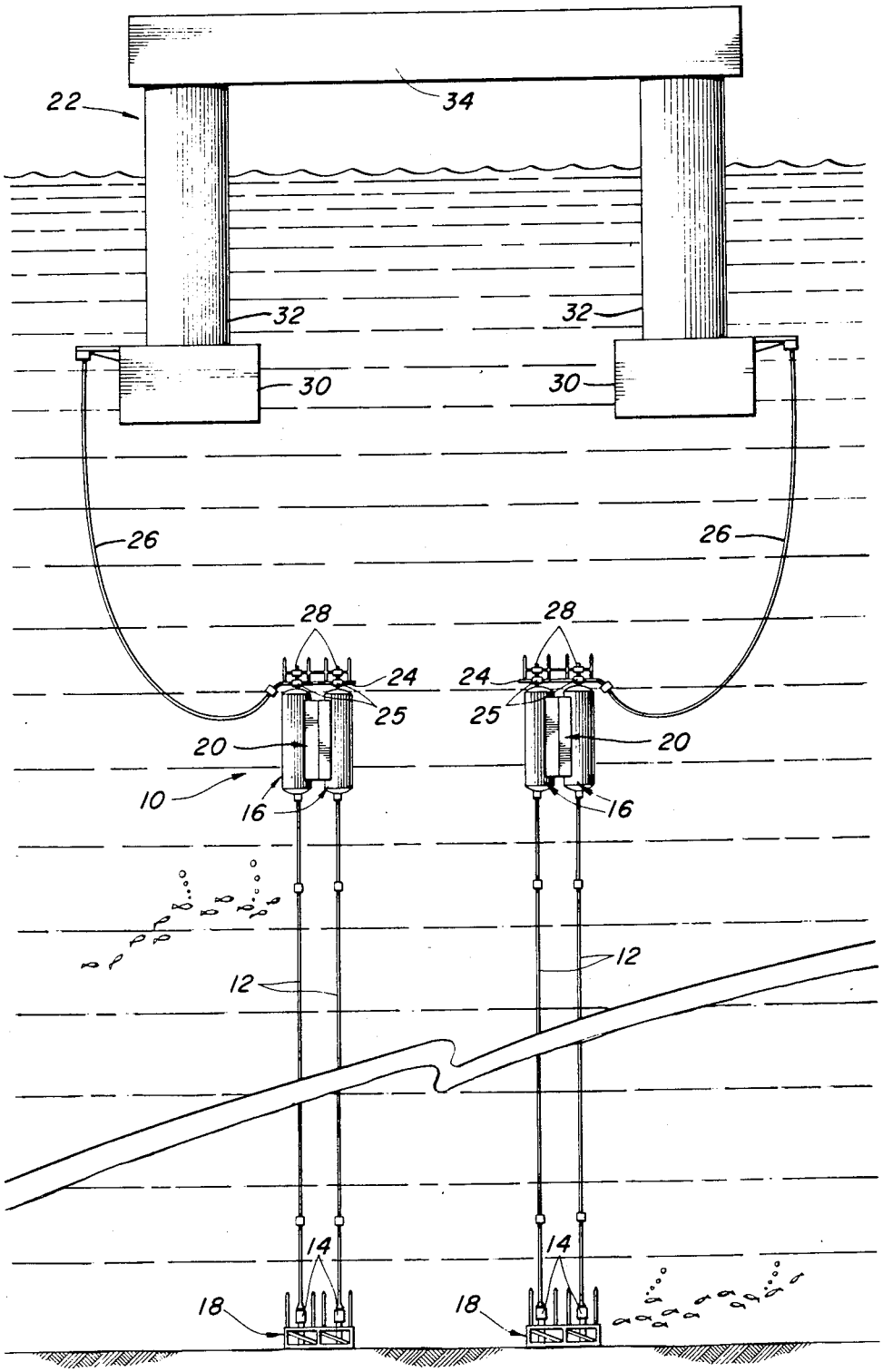
FIG. 1 is a schematic side view of the near-surface completion system of the present invention operatively interconnected to the subsea wells and to the floating production platform.

The modular near-surface completion system of the present invention is shown in FIG. 1 generally at 10. The completion system comprises a rigid riser 12 for each subsea wellhead 14 and a riser buoy 16 attached to each riser. While other configurations are possible, a four well template 18 is preferred with the wellheads 14 positioned in a square (or rectangular) pattern. Connection means 20 is provided to interconnect the four riser buoys 16 for a given template 18. Only two templates 18 are depicted in FIG. 1, although a single floating production platform 22 will normally service 4, 6 or even 8 templates in a configuration that may be two or more templates wide and in a generally rectangular pattern extending along the length of the platform 22 (i.e., into the paper). Platform 22 is preferably a semisubmersible platform held in position by a plurality of mooring lines (not shown). Alternatively, a weather vaning, floating production, storage and offtake vessel could be employed. The downhole completion (not shown) of each well in template 18 is preferably hung-off below the mudline (i.e., the bulk of its weight is supported directly by the ocean floor) using a tubing hanger and pack-off. Since the weight of the downhole completion of each well is otherwise supported, this weight need not be included when computing the amount of buoyancy each support buoy need provide. Accordingly, each buoy 16 can be considerably smaller than would otherwise be possible.

An upper template 24 may be positioned atop buoys 16 to provide a work platform for divers, a support for flowline connections, additional means to interconnect buoys 16, and the like. Flexible riser 26 may be comprised of four individual sets of flow lines, one set for each wellhead 28 or a manifold (not shown) may combine the production from the four wells for conduction to the surface by flexible riser 26. A preferred alternative is that the production from two wellheads 28 be combined in a single riser 26 necessitating two riser 26 for each template (or buoy cluster). It is preferred that riser 26 interface with the floating production platform 22 at the level of pontoons 30 to minimize (a) the required length, (b) exposure to waves, (c) possible interference with other platform structures and the like. Other interface levels are, of course, possible. Well fluids may be stored in tanks (not shown) in the legs 32 of the platform 22 or on deck 34 for subsequent removal.

Figure 3:
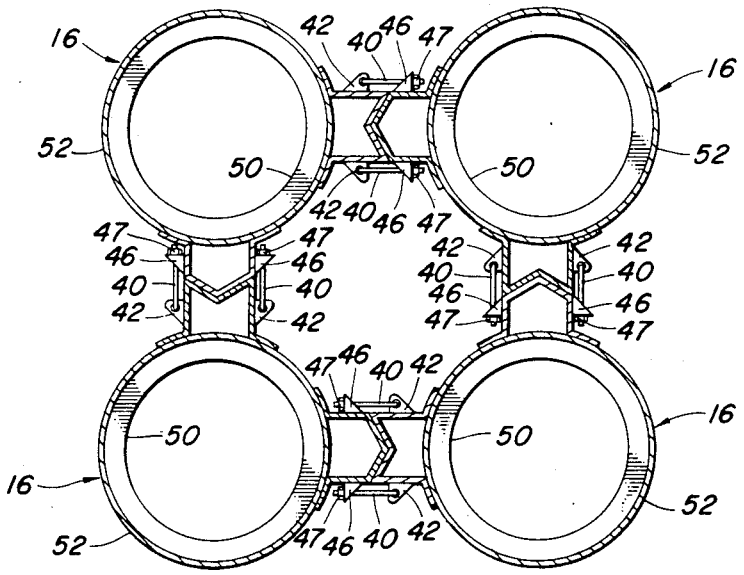
FIG. 3 is a cross-sectional top view as seen along line 3—3 in FIG. 2.
Figure 2:
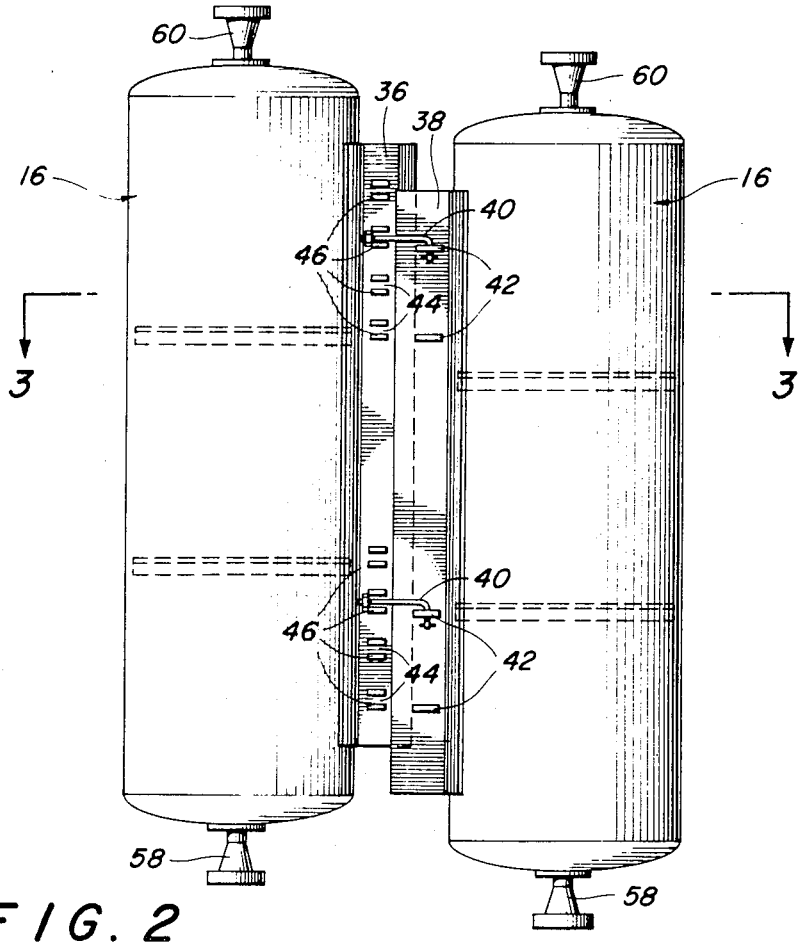
FIG. 2 is a detailed side view showing the interconnection between adjacent buoys of the present near-surface completion system.

One embodiment of interconnecting means 20 is shown in greater detail in FIGS. 2 and 3. This interconnection is intended to be exemplary of structure for interconnecting the four riser buoys 16. Convex and concave spacers 36 and 38, respectively, are provided on each buoy 16 in generally orthogonal relationship. The inclined mating surfaces of spacers 36 and 38 facilitate alignment of adjacent buoys 16. Swing bolt 40 extends from the ear 42 on concave spacer 38 through slot 44 in ear 46 in convex spacer 36. Nut 47 is threaded onto bolt 40 and is tightened down to lock spacer 36 in a fixed position relative to spacer 38. A pluraliy of ears 46 are provided on convex spacers 36 to permit variation in the positions of adjacent buoys as may be made necessary by variations in the height of the wellheads 14 on the ocean floor. If desired, a plurality of ears 42 on concave spacers 38 may be provided to permit even greater flexibility in the relative positioning of adjacent buoys 16. As a minimum, it is desired the connector be able to accommodate a one foot height differential in each direction (i.e., $\pm 1$ ft) (see FIGS. 2 and 5).

Figure 4:
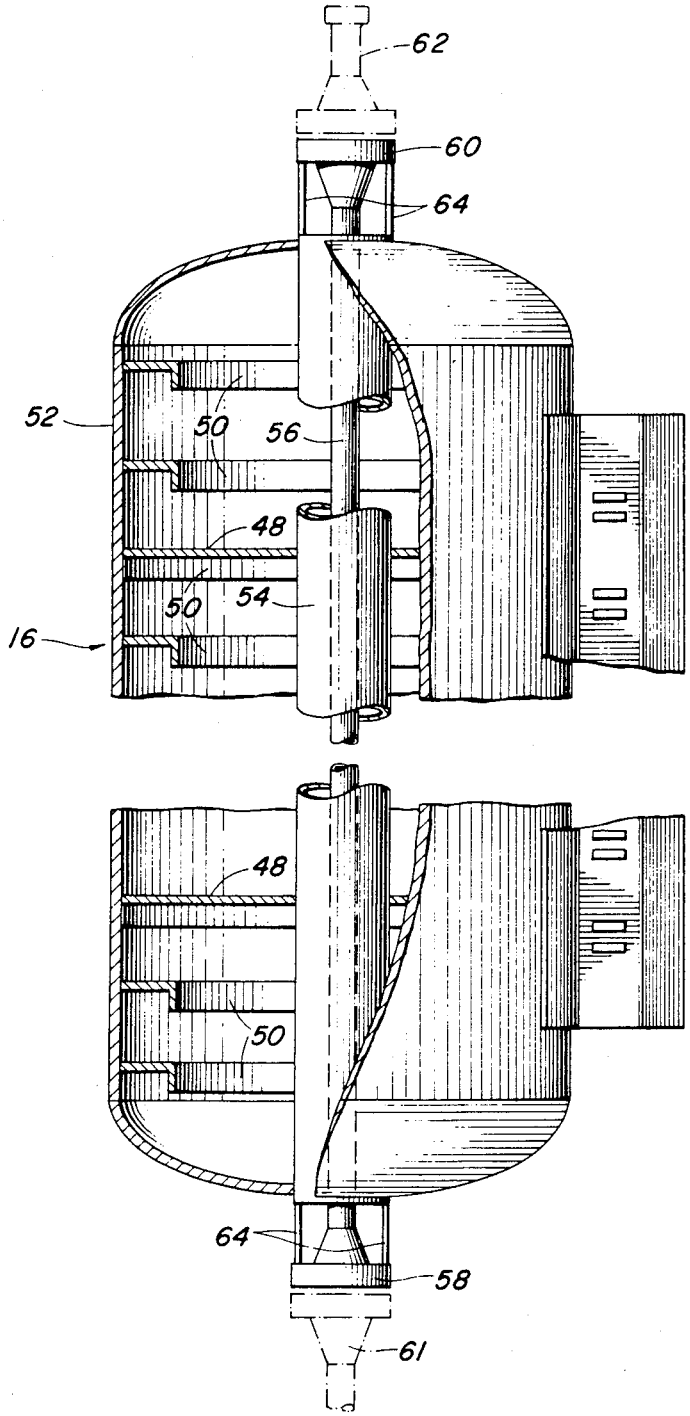
FIG. 4 is a detailed side view partially in section of one embodiment of a buoy configuration that may be utilized in the near-surface completion system of the present invention.

The details of a representative buoy design are best seen in FIG. 4. By way of example and not limitation, each buoy is 35 feet in length and 16 feet in diameter. The buoy 16 is subdivided by plates 48 into a minimum of three compartments and has sufficient buoyancy that it can provide adequate tension on riser 12 even if one of the compartments becomes flooded. A plurality of ring stiffeners 50 are provided to stiffen the hull 52 of buoy 16. Riser tube 54 seals off the interior of buoy 16 providing a passage for riser 56 therethrough. Riser 56 may be any desired size but, by way of example, can be $9\frac{5}{8}''$, the same diameter as riser 12. Riser 56 is provided with flanges 58 and 60 to facilitate connection to riser 12 and to connector mandrel 62 which in turn is attached to upper template connector 25 (FIG. 1). Support spiders 64 are provided around flanges 58 and 60 to reinforce them and provide for load transmittal to and through buoy 16.

Figure 5:
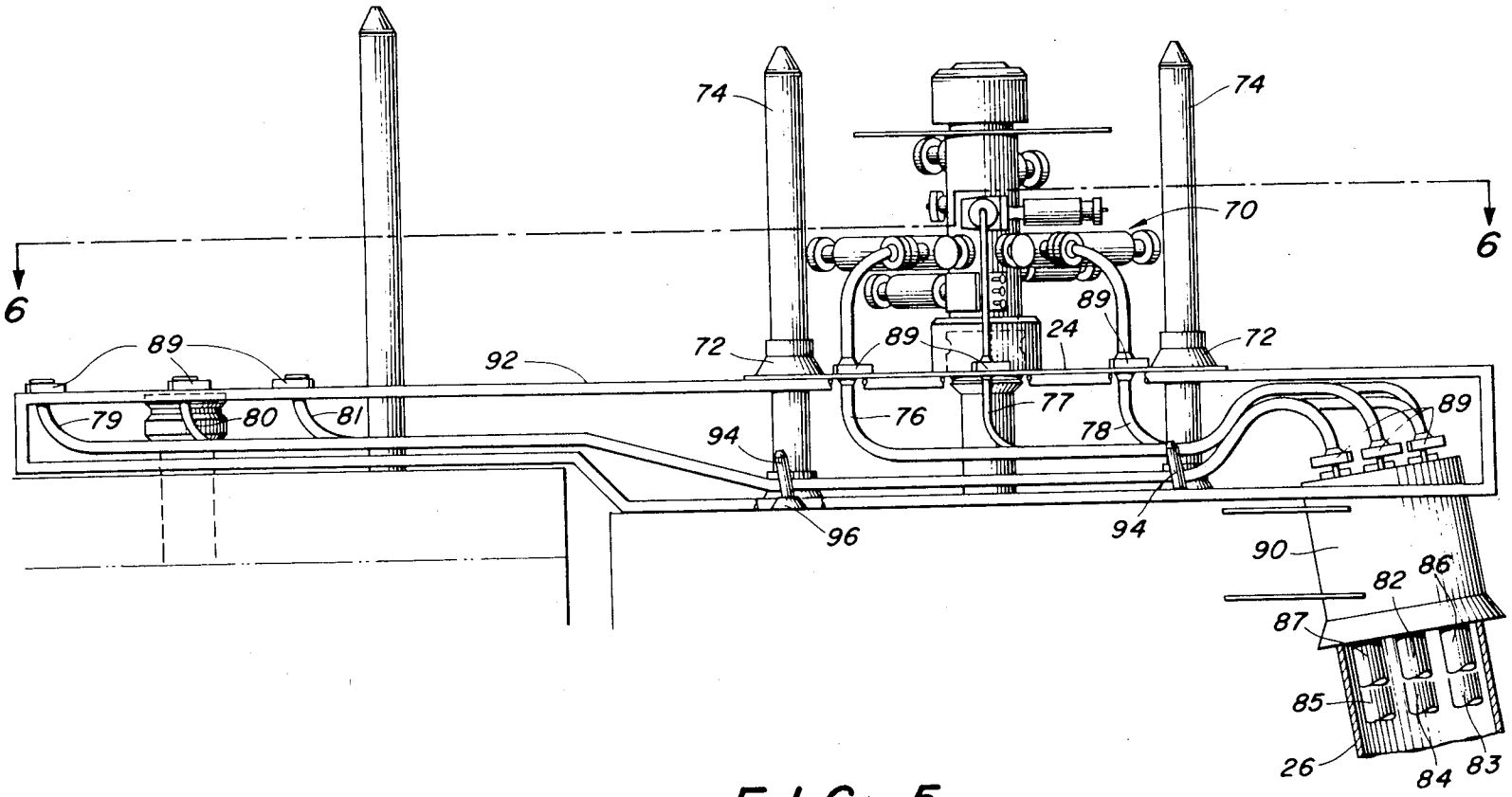
FIG. 5 is a detailed side view of the completion system with an exemplary Christmas tree in place and the front two buoys removed for clarity.
Figure 6:
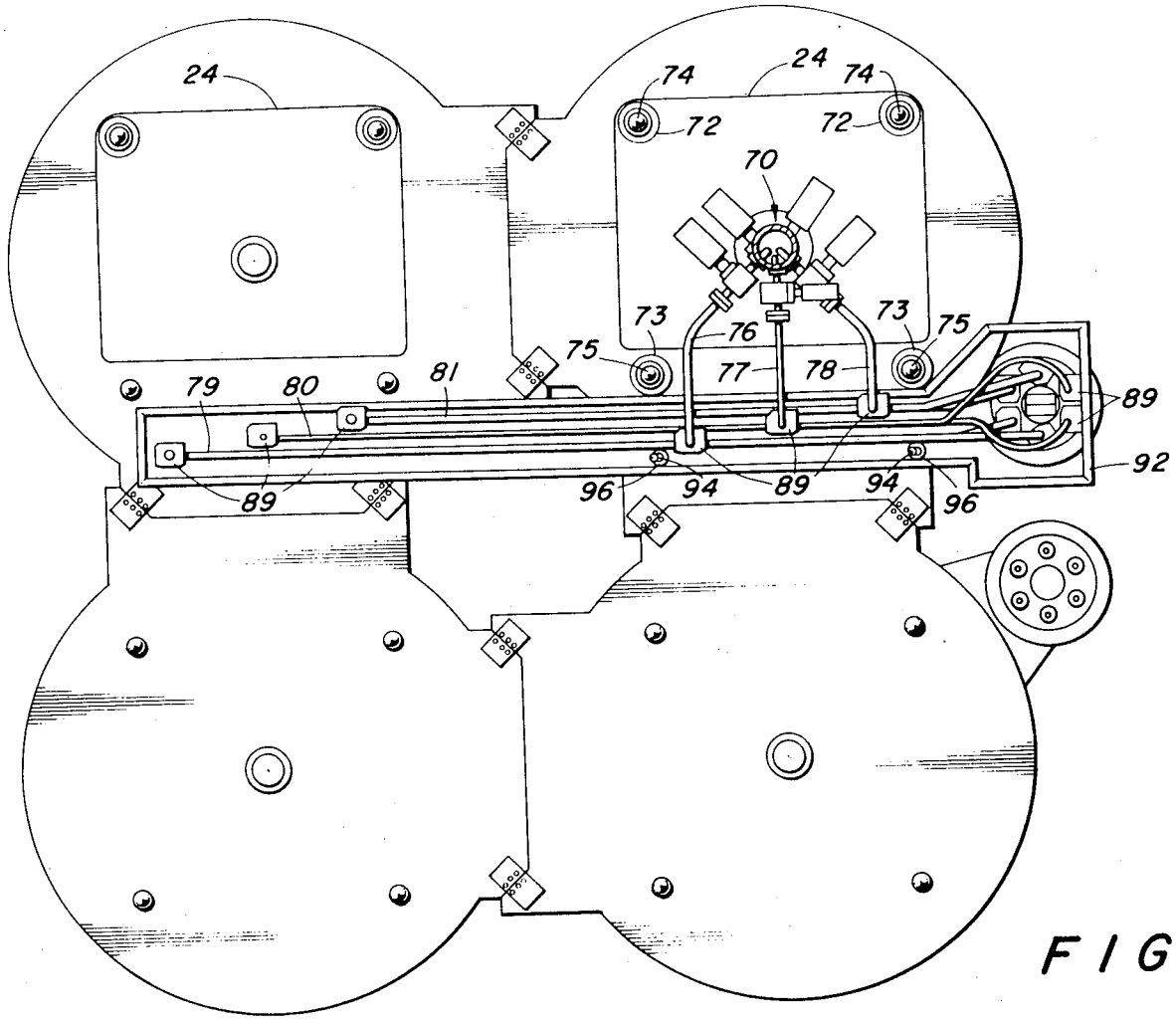
FIG. 6 is a top view of the completion system as seen along line 6—6 of FIG. 5.

In FIGS. 5 and 6, a single Christmas tree 70 is shown in order to depict how the modular near-surface completion system interfaces between the subsea wellhead 14 and the production platform 22. Christmas tree 70 is mounted atop completion wellhead 28. The tree subassembly is lowered in place by engaging tree guide funnels 72 over guide posts 74.

Typically, three strings of production tubing 11 are contained in each rigid riser 12, two production strings and one well injector. Conventional valving and connections are provided in Christmas tree 70, with the three connector lines 76, 77, 78 maintaining the flow from the three production tubing strings isolated. Lines 76, 77 and 78 connect with flowlines 82, 83 and 84, respectively, maintaining the flow from and to wellhead 14 in the three lines 11 to and from platform 22 separate. Three connectors 79, 80 and 81 transmit flow to and from a second wellhead 14 to flowlines 85, 86 and 87 within flexible riser 26.

Conventional clamp assemblies 89 are used to make the various line connections and flowline receptacle 90 holds flowlines 82–87 securely in place beside, and slightly angulated with respect to, buoy 16 to encourage the formation of the catenary loop in flexible riser 26. Pipe basket 92 provides a support structure for connector lines 76–81. Angled guide pins 94 locate pipe basket by means of guide funnels 96 in conjunction with guide funnels 73 and guide rods 75. Funnels 73 and 96 are affixed to the pipe basket 92 as by welding, or the like.

The present invention provides a modular near surface completion system 10. Each subsea wellhead 14 is provided with its own riser 12 and with its own production wellhead 28 and Christmas tree 70 supported by its own riser buoy 16. This enables each individual buoy 16 to be sized according to the weight it will be required to support. Produced well fluids are conducted to the floating production platform 22 by means of flexible risers 26. The use of flexible risers 26 of sufficient length (i.e., a catenary loop) permit the platform to be moved by adjustment of its mooring lines so that it can be positioned over a particular template 18 for drilling or workover without need to curtail production from the remaining templates 18.

The buoys 16 may be installed on risers 12 individually by divers and then pulled laterally aside using a cable and workboat to permit installation of subsequent buoys 16. The buoys 16 may then be interconnected by swing bolts 40 by a diver. Alternatively, the buoys 16 may be preassembled in the desired configuration on shore and keel hauled to the site and assembled to risers 12 as a unit. The desired configuration will of course be known from having previously installed and leveled template 18. This latter technique appears to have an economic benefit in terms of reduced installation time. The buoys are positioned in a quiescent zone 100 to 500 feet (30.5 to 152.4 meters) beneath the surface of the ocean. This location simultaneously protects the well trees 70 from surface weather (wind and waves) while elevating the trees from the sub-1000 foot (305 meter) depths which require more heavy duty structures to function in such pressures. Lastly, all exploratory drilling and reservoir delineation can be done from the surface prior to any expenditures for production buoys, wellheads and related equipment.

Various changes, alternatives and modifications will become apparent to persons of ordinary skill in the art following a reading of the foregoing specification. Accordingly, it is intended that all such changes, alternatives and modifications as fall within the scope of the appended claims be considered part of this invention.

I claim:

1. A modular near-surface completion system for a plurality of subsea wells in deep water, wherein each of said plurality of subsea wells has been drilled and cased from a mudline and completed with a lower tubing hanger below the mudline, said near-surface completion comprising:

a first plurality of production risers, one said production riser extending from each of said plurality of subsea wells to a quiescent zone beneath the surface of the sea; a plurality of riser buoys positioned in said quiescent zone out of a subsurface sea region affected by the action of wind and waves, one each of said plurality of riser buoys being attached to one of said first plurality of production risers, each of said buoys having positive buoyance in an amount exceeding the weight of respective elements it supports; a plurality of well completion trees with a single well completion tree mounted atop each of said riser buoys; means for connecting each of said plurality of well completion trees to an above-surface production facility; means interconnecting at least one of said riser buoys directly to one or more additional adjacent riser buoys of said plurality of riser buoys to increase stability of said near-surface completion system by substantially fixedly interconnecting said adjacent riser buoys, said interconnecting means including a plurality of attachment points capable of accomodating variations in vertical positioning of said adjacent buoys.

2. The modular near-surface completion system of claim 1 wherein said above surface production facility comprises a floating production system.

3. The modular near-surface completion system of claim 2 wherein the floating production system comprises a semisubmersible platform.

4. The modular near-surface completion system of claim 2 further comprising flexible riser means interconnecting said plurality of well completion trees to said floating production system.

5. The modular near-surface completion system of claim 1 wherein said riser buoy is located in a region extending from 150 to 500 feet beneath the surface of the sea in order to provide access to divers.

6. The modular near-surface completion system of claim 1 further comprising a well template having four slots.

7. The modular near-surface completion system of claim 6 further comprising means to interconnect the riser buoys of said well template in a generally square cluster configuration.

8. The modular near-surface completion system of claim 1 wherein said means for interconnecting said riser buoys comprises interlocking male and female spacer boxes.

9. The modular near-surface completion system of claim 8 wherein said means for interconnecting said riser buoys further comprises securing means connecting said interlocking spacer boxes one to the other.

10. The modular near-surface completion system of claim 9 wherein said securing means comprises a first plurality of swing bolts.

11. The modular near-surface completion system of claim 10 wherein said securing means further comprises a second plurality of attachment plates each having a slot for receiving one said swing bolt.

12. The modular near-surface completion system of claim 11 wherein said second plurality is greater than said first plurality such that each swing bolt has a multiplicity of attachment plates that may receive it to accommodate variations in vertical positioning of adjacent buoys.

13. The modular near-surface completion system of claim 8 wherein each buoy has a male spacer box and a female spacer box generally orthogonally positioned about the periphery of said riser buoy.

14. The modular near-surface completion system of claim 1 wherein said means for interconnecting at least one of said buoys to at least one other of said plurality of buoys includes means to accomodate a one foot height differential between said adjacent buoys.

15. The modular near-surface completion system of claim 1 wherein each said production riser passes through a riser tube which extends longitudinally through an interior portion of each respective riser buoy, said riser tube being sealed off from the remaining interior portion of said riser buoy.

* * * * *